US012084861B2

(12) United States Patent
Lukito

(10) Patent No.: US 12,084,861 B2
(45) **Date of Patent: *Sep. 10, 2024**

(54) CONNECTORS FOR USE IN TRUSS SYSTEM

(71) Applicant: Harsoyo Lukito, Orange, CA (US)

(72) Inventor: Harsoyo Lukito, Orange, CA (US)

( * ) Notice: Subject to any disclaimer, the term of this patent is extended or adjusted under 35 U.S.C. 154(b) by 26 days.

This patent is subject to a terminal disclaimer.

(21) Appl. No.: 17/981,436

(22) Filed: Nov. 6, 2022

(65) Prior Publication Data

US 2023/0059688 A1 Feb. 23, 2023

Related U.S. Application Data

(63) Continuation of application No. 17/344,479, filed on Jun. 10, 2021, now Pat. No. 11,499,315.

(51) Int. Cl.
*E04C 3/08* (2006.01)
*E04C 3/04* (2006.01)

(52) U.S. Cl.
CPC ..... *E04C 3/08* (2013.01); *E04C 2003/0491* (2013.01)

(58) Field of Classification Search
CPC ..... E04C 3/08; E04C 2003/0491; E04C 2003/0473; E04C 3/005; F16B 7/0473
See application file for complete search history.

(56) References Cited

U.S. PATENT DOCUMENTS 5,806,265 A * 9/1998 Sluiter ..... E04B 1/58 52/696
9,494,273 B2 * 11/2016 Wang ..... F16B 7/18
9,924,797 B2 * 3/2018 Hanlon ..... A47B 47/0083
10,697,172 B2 * 6/2020 De Almeida Borges ..... E04B 1/388

* cited by examiner

*Primary Examiner* — Babajide A Demuren
*Assistant Examiner* — Daniel J Kenny
(74) *Attorney, Agent, or Firm* — Raymond Sun

(57) ABSTRACT

The present invention provides a truss system a horizontal chord, and a connector retained inside the channel of the horizontal chord. The connector has a base that has two parallel vertical walls, and a connecting base wall that together define a U-shaped cross-section, with a receiving space defined by the two parallel walls and the base wall. First and second dividers are positioned in the receiving space and define separate first, second and third spaces, respectively, with the second space positioned between the first and third spaces. Each of the first and second dividers has a vertical wall section that is connected to the two parallel walls and the base wall, with an angled surface associated with the upper end of each vertical wall section. A vertical web member has one end that is inserted into the second space, and a diagonal web member has one end inserted into either the first space or the third space.

4 Claims, 12 Drawing Sheets

CONNECTORS FOR USE IN TRUSS SYSTEM

BACKGROUND OF THE INVENTION

1. Field of the Invention

The present invention relates to a truss system for use in structures, and in particular, to a connector that is used in such a truss system.

2. Description of the Prior Art

Truss systems are commonly used in a variety of structures to reduce the overall weight without compromising on the strength. As a rule of thumb, the strength of a material is linearly proportional to the weight of that material. Steel is three times heavier than aluminum, and aluminum is three times heavier than wood. In terms of the strength, steel is about three times stronger that aluminum, and aluminum is three times stronger than wood.

Truss systems are commonly used in a variety of structures, ranging from houses to bridges. A conventional truss system usually consists of a top chord, a bottom chord, and a triangular web member that joins the top and bottom chords carrying vertical and axial forces. A truss system can withstand both compression (vertical web members) and tension (diagonal web members) load. Specifically, when the truss system is supporting the load, the vertical web member is for compression load and the diagonal web member is for tensile load. However, a single beam alone can only handle tensile load.

Conventional truss systems usually have the web members welded to the chords. One drawback with this arrangement is that this is more costly to build. Another drawback is that the welded connection results in a fixed connection at the welded locations, with no flexibility in rotational movement which may be caused by tension or compression of the chord. There will be a slight kinematic (angle) change in the web connections This may compromise the structural integrity of the overall structure supported by the truss system.

Truss systems also need to meet certain requirements or balance certain considerations, including but not limited to (i) strength versus weight, (ii) longevity, and (iii) fire rating. Many existing truss systems use wood or steel for their chords and/or web members, but wood and steel are not ideal.

For example, for strength versus weight, based on the dead and live load requirements of a platform, wood is lighter than steel to meet the load requirement. Wood performs better along the grain than across the grain. However, steel is simply too heavy to accommodate the required loads.

For longevity, wood can be attacked by termites, and rot due to moisture. Steel can rust and lose its strength overtime. Therefore, neither are optimal.

Thus, there remains a need for a truss system that can withstand both compression (vertical web members) and tension (diagonal web members) loads, while overcoming the drawbacks discussed above.

SUMMARY OF THE DISCLOSURE

The present invention provides a connector that is adapted for use in a truss system.

In order to accomplish the objects of the present invention, the present invention provides a truss system a horizontal chord, and a connector retained inside the channel of the horizontal chord. The connector has a base that has two parallel vertical walls, and a connecting base wall that together define a U-shaped cross-section, with a receiving space defined by the two parallel walls and the base wall. First and second dividers are positioned in the receiving space and define separate first, second and third spaces, respectively, with the second space positioned between the first and third spaces. Each of the first and second dividers has a vertical wall section that is connected to the two parallel walls and the base wall, and an upper end, with an angled surface associated with the upper end of each vertical wall section. A vertical web member has one end that is inserted into the second space, and a diagonal web member has one end inserted into either the first space or the third space.

The present invention is made of aluminum and is especially adapted for use in horizontal structure applications; specifically for horizontal platforms, such as large motion base platforms for use in a theater, floor and roof web members for a house or building.

DETAILED DESCRIPTION OF THE PREFERRED EMBODIMENTS

The following detailed description is of the best presently contemplated modes of carrying out the invention. This description is not to be taken in a limiting sense, but is made merely for the purpose of illustrating general principles of embodiments of the invention. The scope of the invention is best defined by the appended claims.

Figure 1:
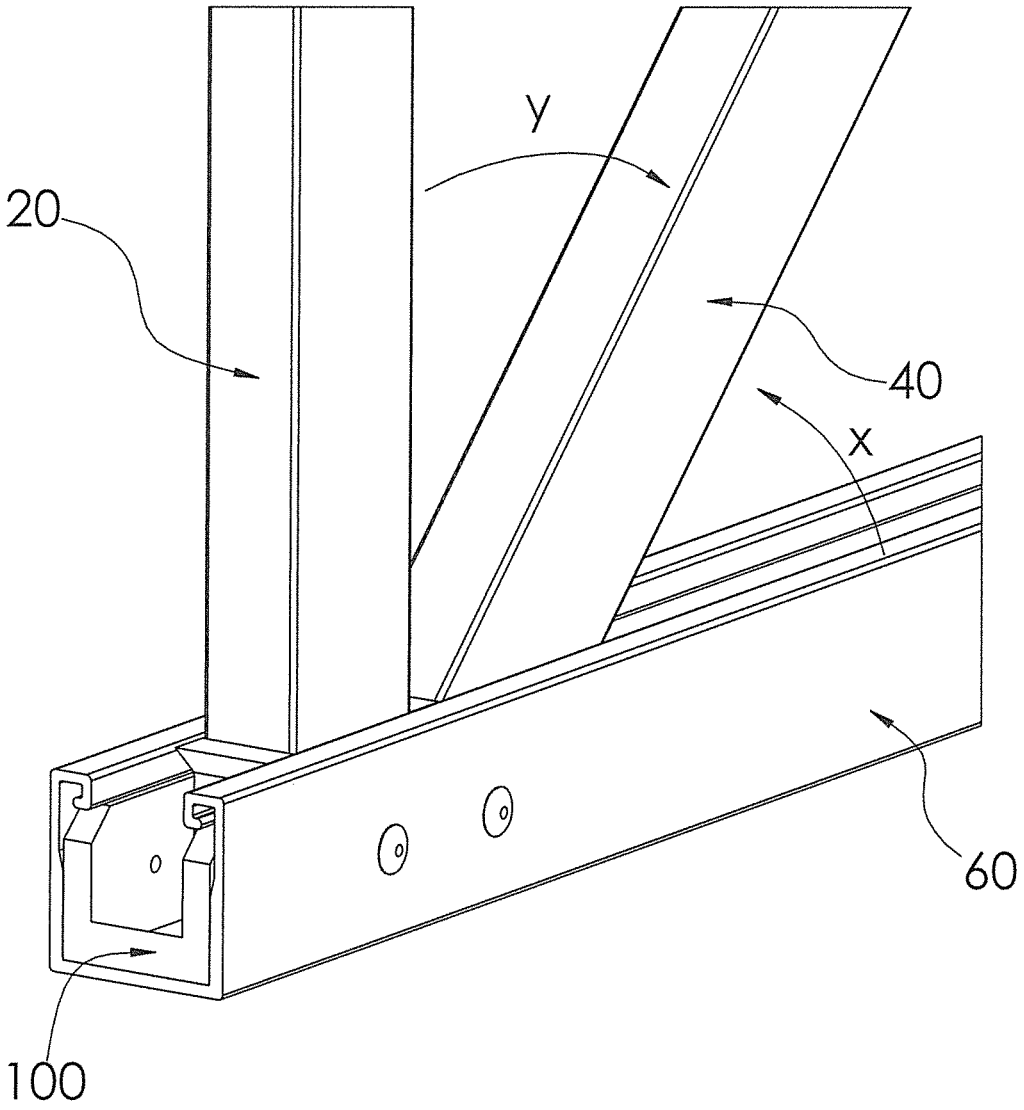
FIG. 1 is a perspective view of a truss connector assembly according to one embodiment of the present invention.
Figure 2:
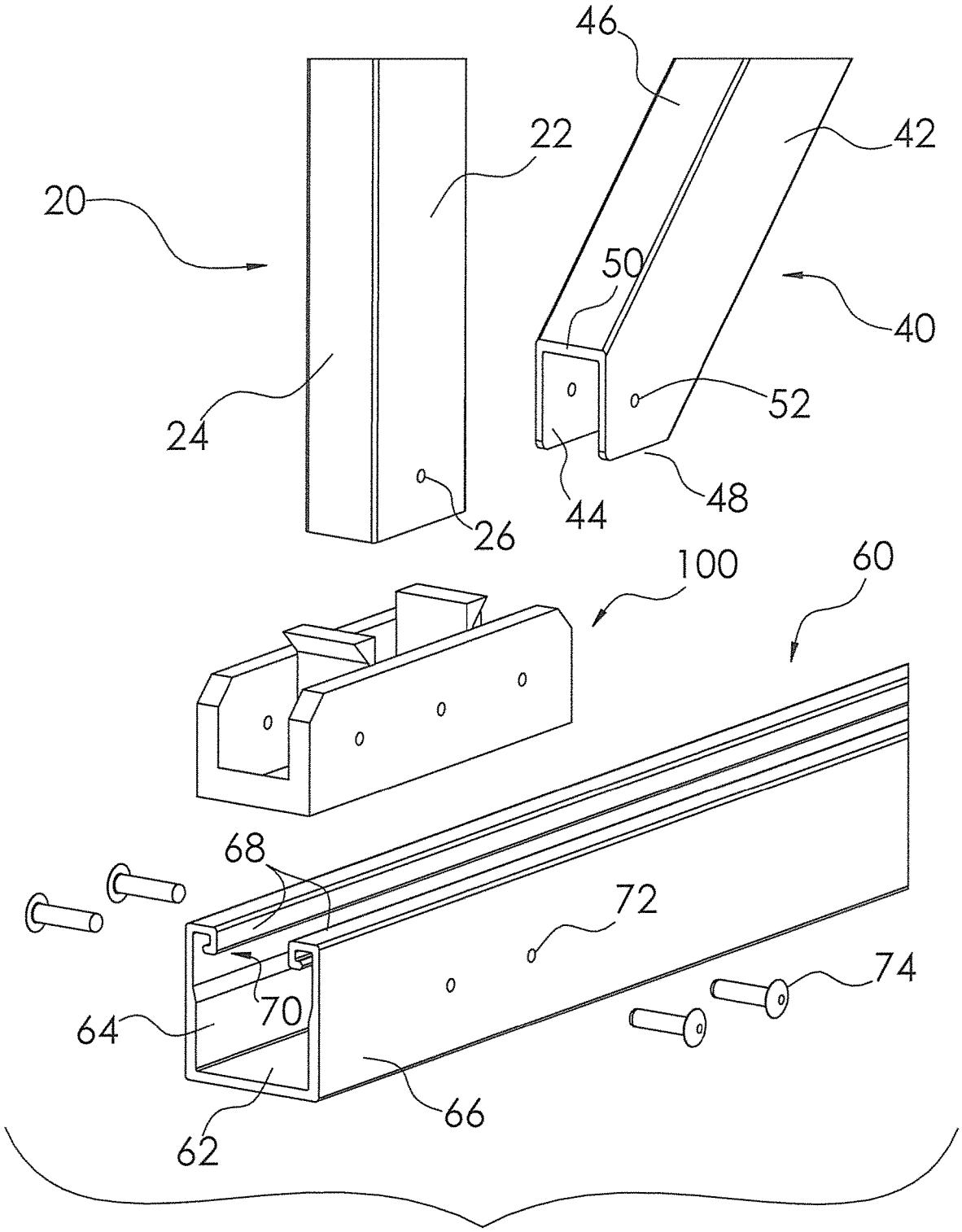
FIG. 2 is an exploded perspective view of the assembly of FIG. 1.
Figure 3:
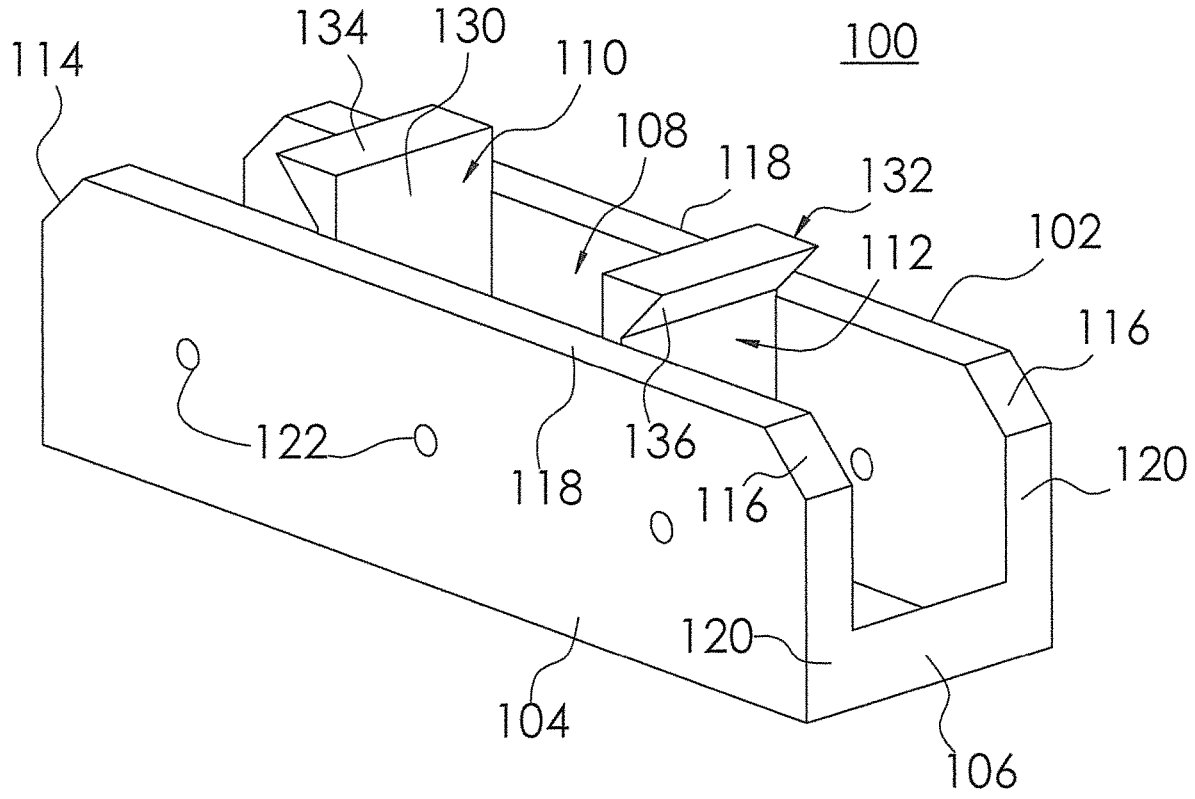
FIG. 3 is a perspective view of a connector that is used in the assembly of FIG. 1.

FIGS. 1 and 2 illustrate a truss connector assembly which includes a connector 100, a plurality of vertical web members 20, a plurality of diagonal web members 40, and a horizontal chord 60.

Each vertical web member 20 has a generally rectangular cross-section with four outer walls (two length walls 22 and two width walls 24), and two opposite opened ends. An opening 26 is provided in each length wall 22. Each wall 22 and 24 has the same height. The top end and bottom end of the vertical web members 20 can be the same. In this regard, each vertical web member 20 can be made out of an aluminum tubing.

Each diagonal web member 40 has a front wall 42, a rear wall 44, and at least one connecting wall 46 that connects the front wall 42 and the rear wall 44. The diagonal web member 40 and its walls 42, 44 and 46 are oriented diagonally, or at an angle with respect to the vertical. The base of each front and rear wall 42 and 44 has a horizontal edge 48, and each diagonal web member 40 has an n-shaped vertical face 50 that is defined by the vertical bottom ends of the three walls 42, 44 and 46. An opening 52 is provided near the base of the front and rear walls 42 and 44. Assuming that the angles x and y (see FIG. 1) defined by the diagonal web member 40 with respect to the vertical web member 20 and the chord 60 are the same (i.e., 45 degrees), then the upper end of the diagonal web member 40 would be the same as the lower end shown in FIG. 2. If the angles x and y are 30 and 60 degrees, respectively, then the opposite angles at the upper end would be 60 and 30 degrees, respectively. Similarly, if the angles x and y are 70 and 20 degrees, respectively, then the opposite angles at the upper end would be 20 and 70 degrees, respectively.

Figure 4:
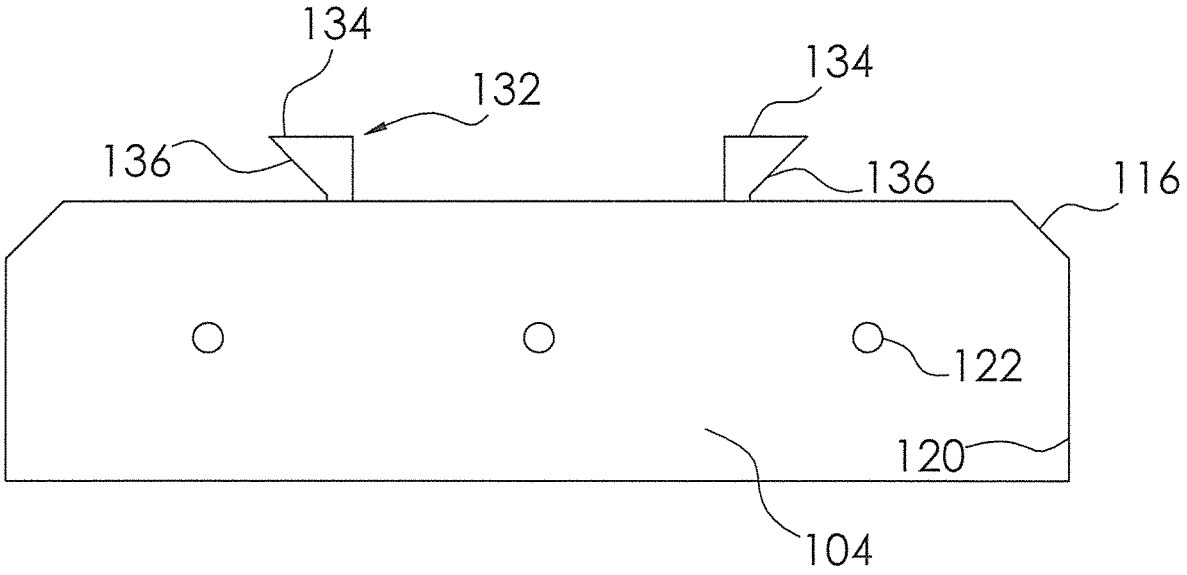
FIG. 4 is a front or length view of the connector of FIG. 3.
Figure 5:
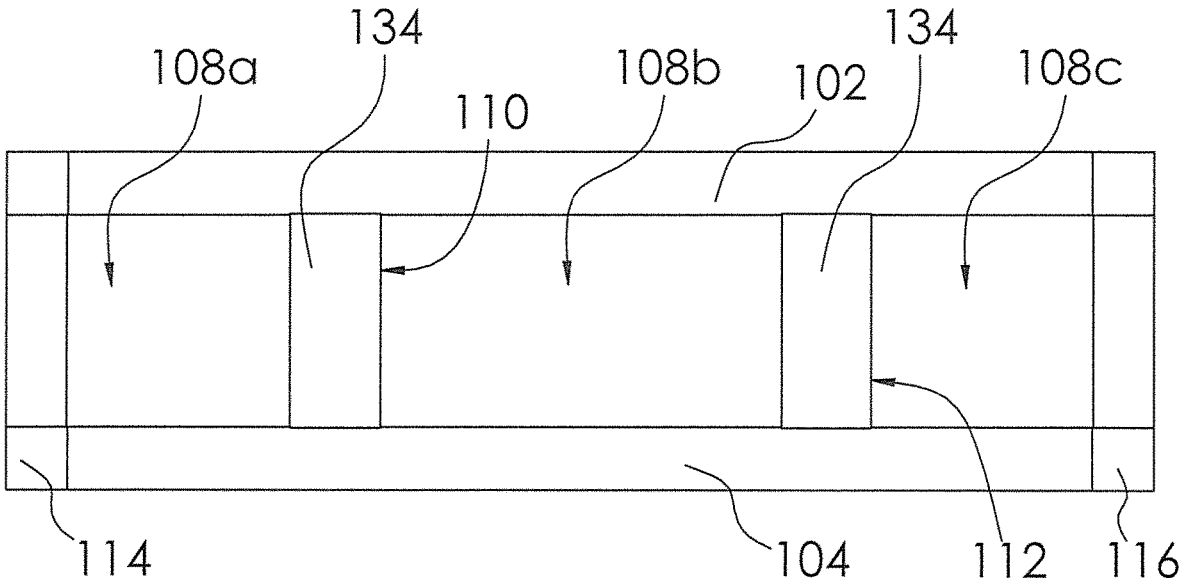
FIG. 5 is a top view of the connector of FIG. 3.
Figure 6:
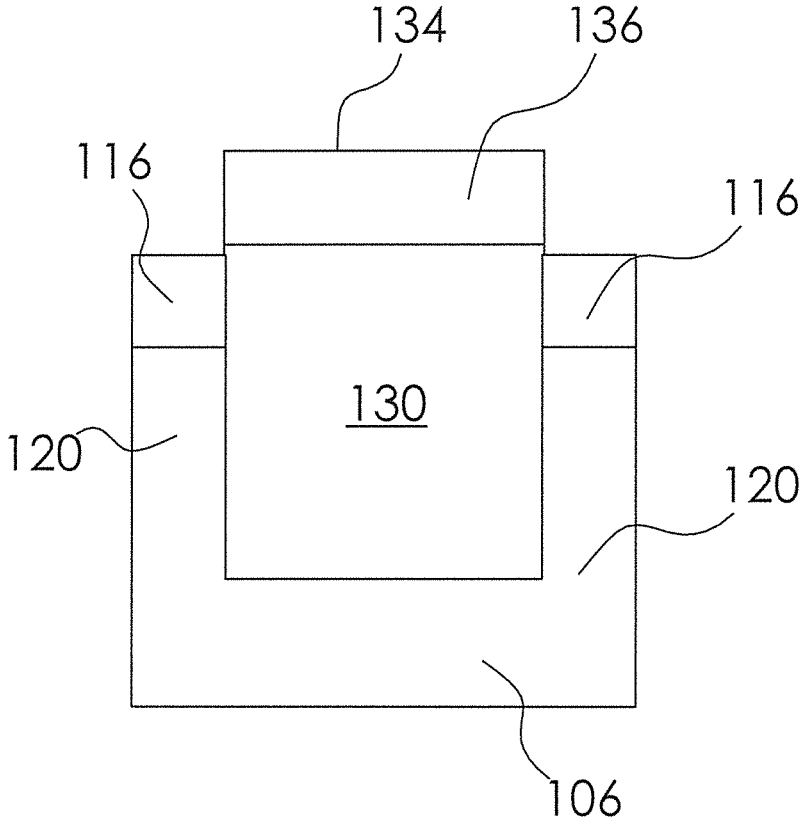
FIG. 6 is a side or width view of the connector of FIG. 3.

FIGS. 1 and 2 only show one horizontal chord 60, but there is usually another horizontal chord 60 provided above the web members 20 and 40. Each of these horizontal chords 60 can be configured as any conventional horizontal chord, or can be embodied using any of the strut configurations shown and described in U.S. Pat. No. 10,526,786, whose disclosure is incorporated by this reference as though set forth in full herein. For example, the horizontal chord 60 can be similar to the channel shown in FIG. 4A of U.S. Pat. No. 10,526,786, which has a back inner surface 62, two side inner surfaces 64 and 66, and two flanges 68 at the front of the channel. The surfaces of the channel are substantially planar and extend the length of the chord 60 which the channel is defined by. The side inner surfaces 64, 66 extend from and are substantially perpendicular to the back inner surface 62, and further are substantially parallel to each other. The side inner surfaces 64, 66 and the back inner surface 62 define three sides of the channel, wherein the fourth side completing the rectangle is referred to as the front of the channel. An opening 70 to the channel is defined by the space between the opposing flanges 68. Openings 72 can be provided in the walls of the horizontal chord 60.

Referring now to FIGS. 3-6, the connector 100 has a base that has two parallel vertical walls 102 and 104, and a connecting base wall 106 that define a U-shaped cross-section. A receiving space 108 is defined by the three walls 102, 104 and 106. This receiving space 108 is divided into three separate spaces 108*a*, 108*b* and 108*c* by two dividers 110 and 112. Each parallel wall 102 and 104 has a beveled edge 114 and 116 at each of its opposite ends that connect the top edge 118 and the vertical end edge 120. A plurality of spaced-apart openings 122 are provided in each parallel wall 102 and 104. Each divider 110 and 112 has a vertical wall section 130 that is connected to the inner sides of the walls 102, 104 and 106, and a triangular section 132 that extends above the top edges 118. Each triangular section 132 has a flat top surface 134, a rear surface that is co-extensive with the surface of the wall section 130 (i.e., the surface of the wall section 130 extends all the way to a first edge of the flat top surface 134), and an angled surface 136 that extends from the other second edge of the flat top surface 134 to the wall section 130.

Referring to FIGS. 1-2, the connector 100 can be used in the truss system to connect a vertical web member 20 and one or two diagonal web members 40. FIGS. 1-2 show the lower end of the truss system. The connector 100 is slid inside the channel of the horizontal chord 60, and secured with the top edges 118 fitted below the flanges 68 using pins 74 that are extended through the openings 72 and 122. The bottom end of the vertical web member 20 can be inserted into the space 108*b*, and the bottom end of a diagonal web member 40 can be inserted into either the space 108*a* or the space 108*c*, or two diagonal web members 40 can be inserted into the two spaces 108*a* and 108*c*. The angled surfaces 136 orient the diagonal web member(s) 40 in a diagonal orientation. Pins 74 can then be inserted through the openings 72, 122, and either 26 or 52 to secure the connector 100, the vertical web member 20, and the diagonal web member(s) 40 at the designated locations along the horizontal beam 60. The same connection using another connector 100 can be used at the upper end of the truss system.

The two dividers 110 and 112 function as orientation devices for web membering and orienting the various vertical web member 20 and diagonal web members 40 into their desired orientations while providing sufficient stability for web membering heavy loads.

The connector 100 and pins 74 of the present invention provide a truss system that addresses the drawbacks of the conventional welded truss systems described above. First, the connector 100 makes it easier to assemble the truss system, and provides the flexibility to assemble a truss system using different types of chords 60. Second, the pins 74 provide flexibility in rotational movement which may be caused by tension or compression of the chord 60. Since the vertical web member is for compression load and the diagonal web member is for tensile load, there will be a slight kinematic (angle) change in the web connections, so the pin 74 can accommodate this slight angle change better than the fixed welded connections in the prior art.

All of the vertical web member 20, the diagonal web member 40 and the horizontal chord 60 are preferably made of aluminum. There are many advantages for using aluminum versus wood or steel.

For example, for strength versus weight, aluminum structures (e.g., tubing) can withstand a much larger load and weigh less when compared to solid wood. Based on the dead and live load requirements of a platform, an aluminum truss will be the lightest, compared to wood and steel, to meet the load requirement. Aluminum is also isotropic (i.e., same properties in all directions), while wood performs better along the grain than across the grain. Steel is simply too heavy to accommodate the required loads.

For longevity, wood can be attacked by termites, and rot due to moisture. Steel can rust and lose its strength over time. Aluminum would be a better choice for long-term application.

For fire-rating, aluminum will provide a better fire rating than wood.

The connector 100 of the present invention facilitates these advantages by securing all the connecting chords and web members intricately, and managing both the compression and tension loads. The pins 74 that connect all web members and chords through the connector 100 are sized to withstand the tension load, and the compression load is taken by the vertical web member 20 which is secured by the connector 100.

During the assembly process discussed above, it is possible to build a truss of any size or length using these web members 20, 40 by inserting them into the connector 100, and then sizing the pins 74 accordingly for the tensile load. The vertical and diagonal web members 20, 40 are secured by inserting them onto the connector 100, while all members (chords and web members) are pinned within the same connector 100. Thus, the purpose of the connector 100 is to conveniently position all the web members 20, 40 to be connected to either the top chord or the bottom chord. Once positioned, all the corresponding web members 20, 40 are secured by fastening to the top and bottom chords.

Figure 7:
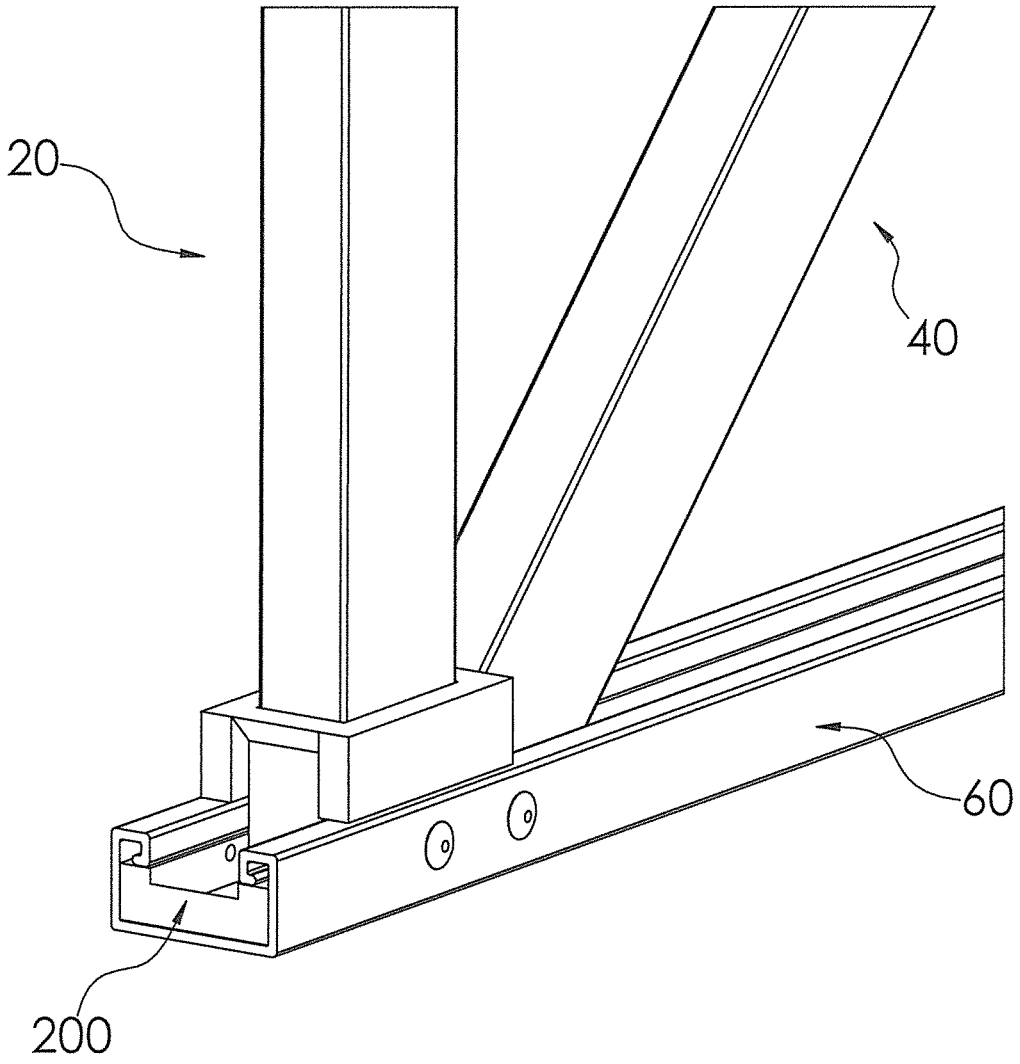
FIG. 7 is a perspective view of a truss connector assembly according to another embodiment of the present invention.
Figure 8:
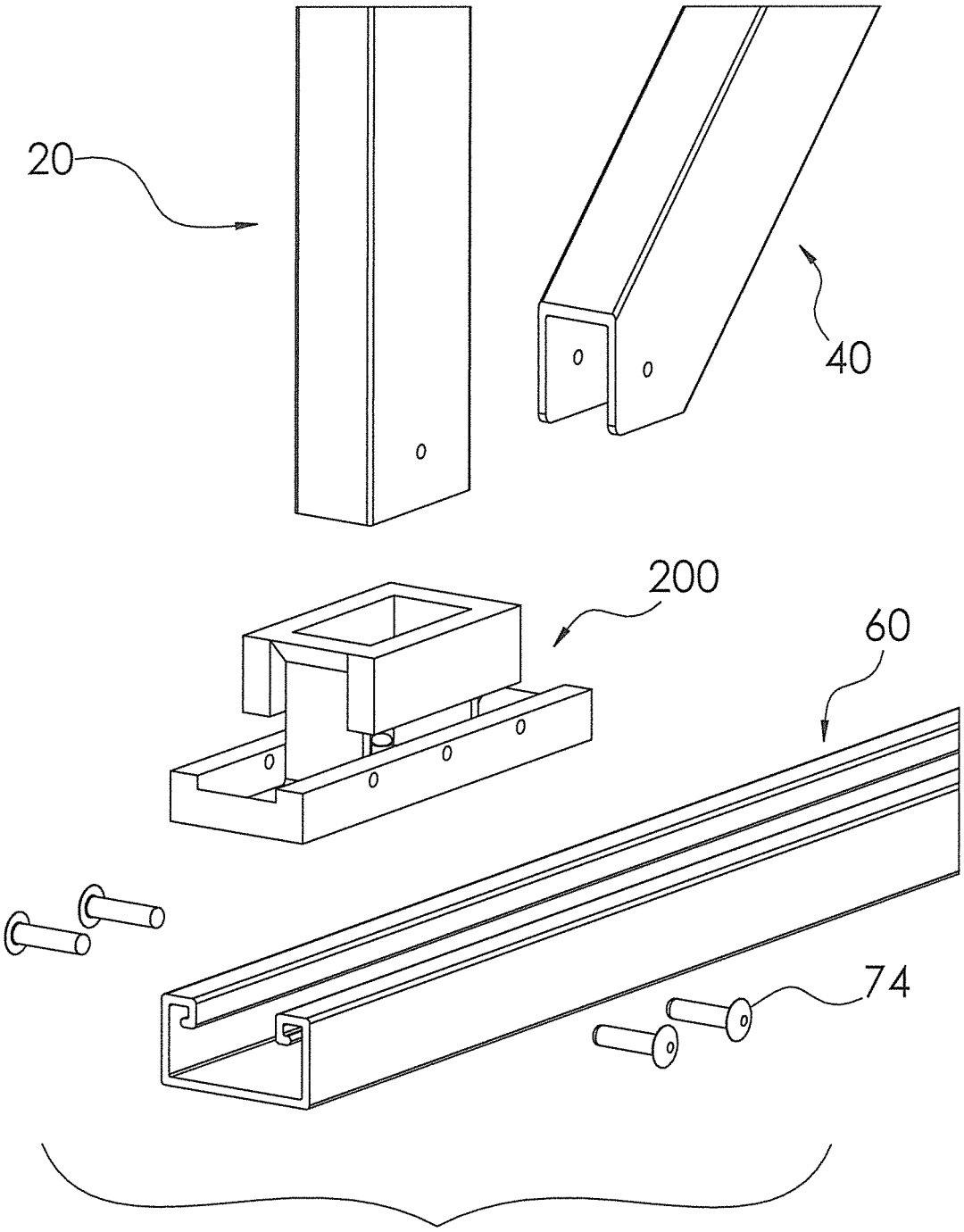
FIG. 8 is an exploded perspective view of the assembly of FIG. 7.
Figure 9:
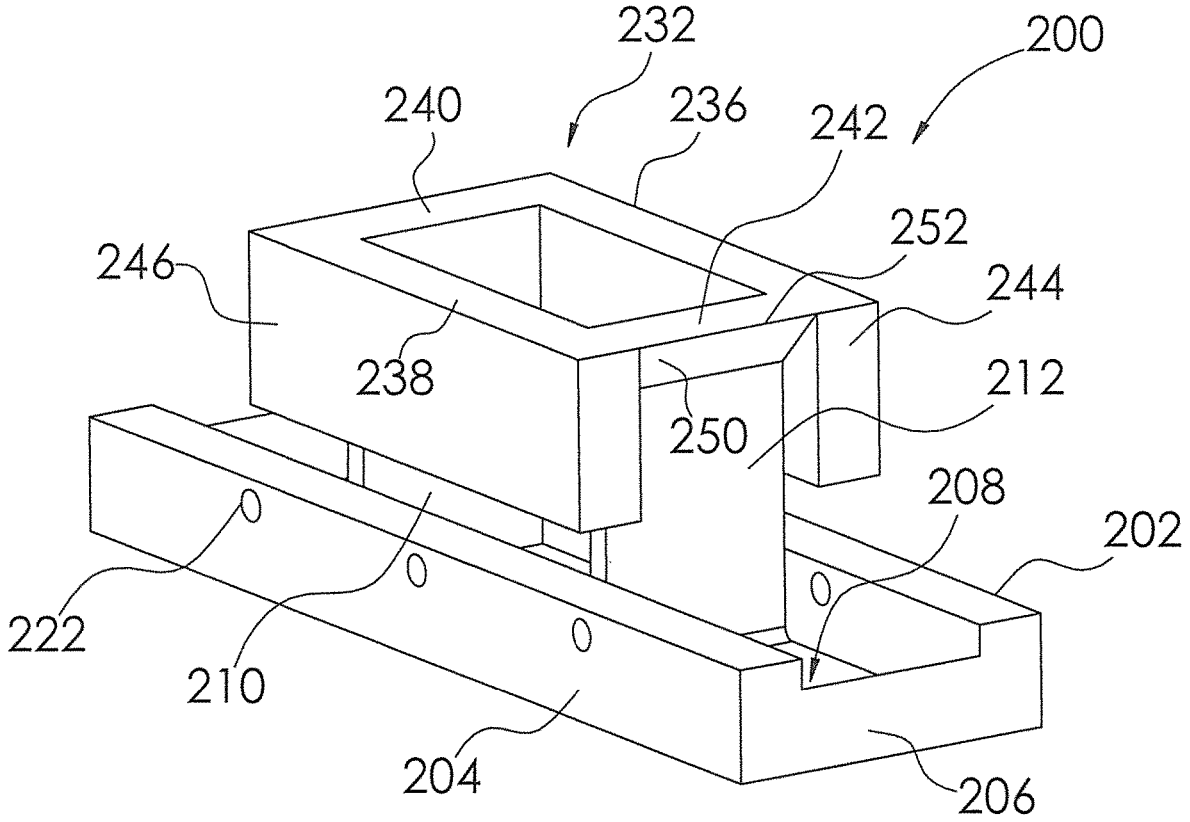
FIG. 9 is a perspective view of a connector that is used in the assembly of FIG. 7.
Figure 10:
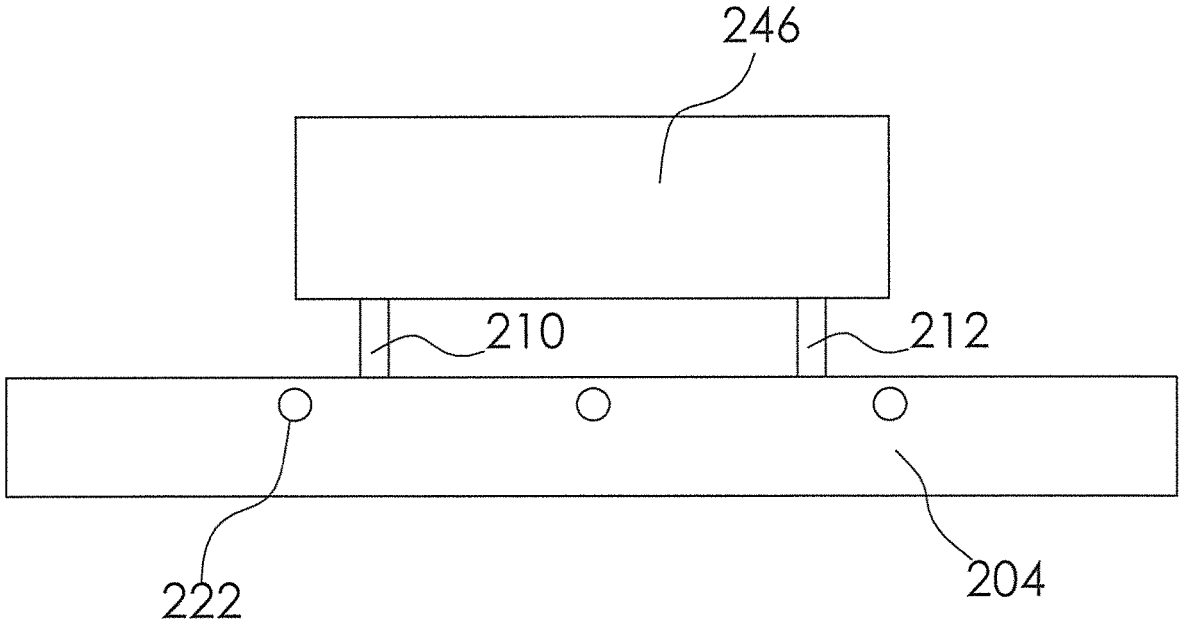
FIG. 10 is a front or length view of the connector of FIG. 9.
Figure 11:
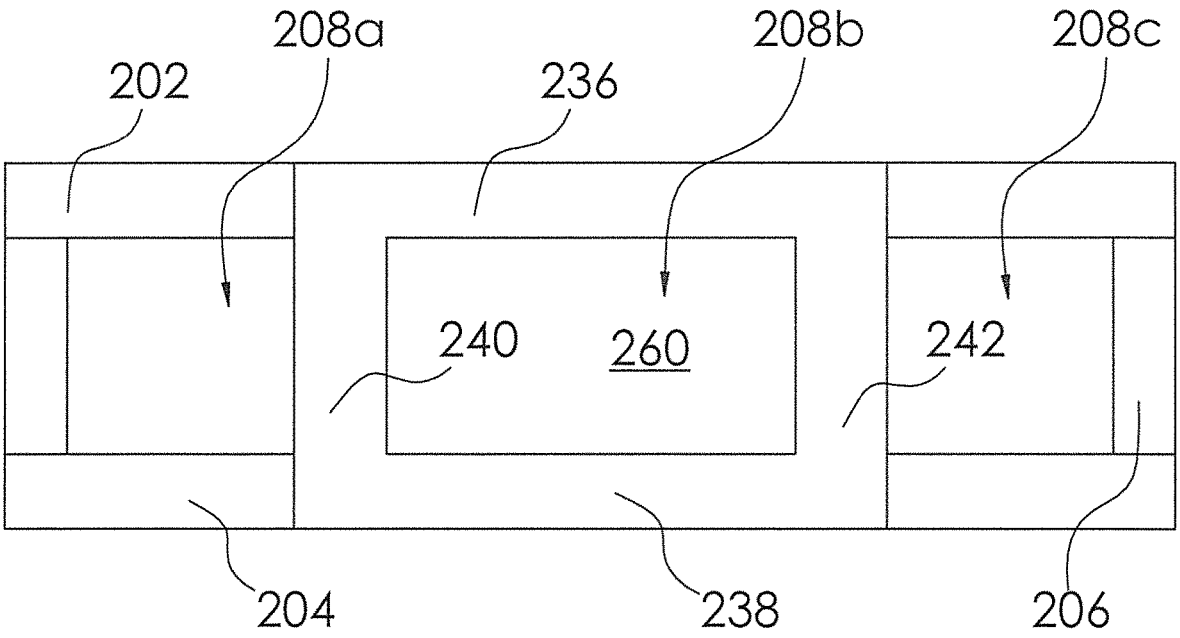
FIG. 11 is a top view of the connector of FIG. 9.
Figure 12:
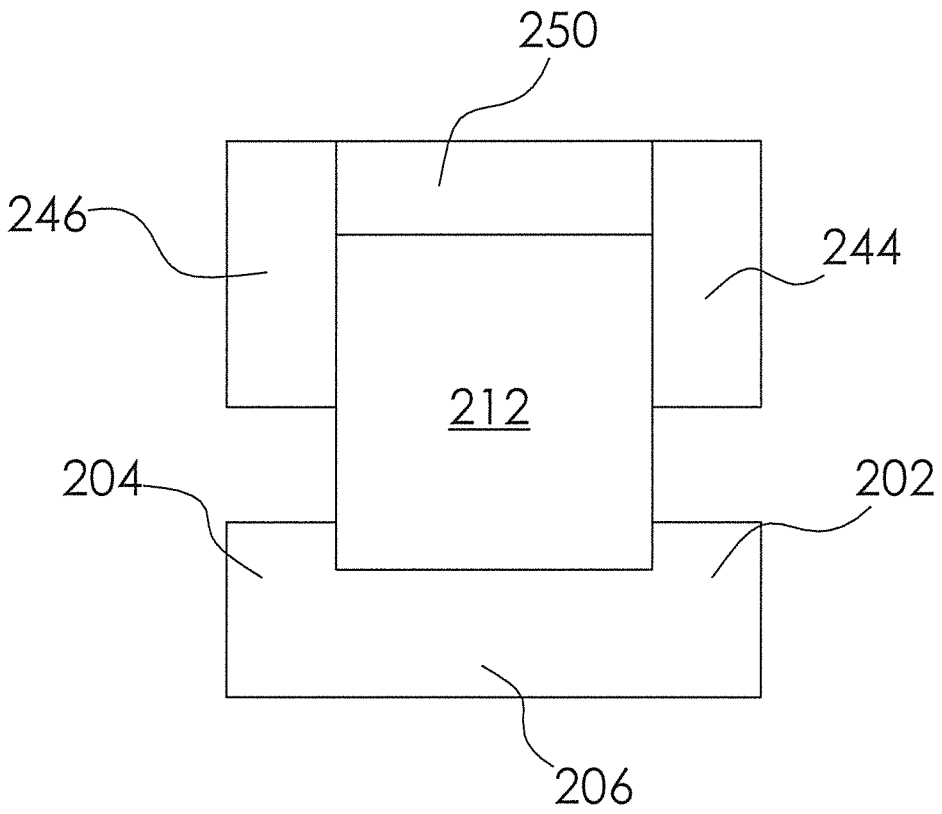
FIG. 12 is a side or width view of the connector of FIG. 9.

FIGS. 7 and 8 illustrate a truss connector assembly which also embodies the same principles described above, but which uses a different connector 200. The plurality of vertical web members 20, the plurality of diagonal web members 40, and the horizontal chord 60, can all be the same as those described in connection with FIGS. 1 and 2. The connector 100 is typically used for deeper chords 60 and the connector 200 for shallower chords 60.

Referring now to FIGS. 9-12, the connector 200 has a base that has two parallel walls 202 and 204, and a connecting base wall 206 that define a short U-shaped cross-section. A receiving space 208 is defined by the three walls 202, 204 and 206. This receiving space 208 is divided into three separate spaces 208*a*, 208*b* and 208*c* by two dividers 210 and 212. A plurality of spaced-apart openings 222 are provided in each parallel wall 202 and 204. Each divider 210 and 212 is essentially a vertical wall where its lower sides are connected to the inner sides of the walls 202, 204 and 206. A top guide piece 232 is secured to (or seated on) the top of the dividers 210 and 212. The guide piece 232 can be provided in one piece with the dividers 210 and 212, or as a separate piece that is secured to the dividers 210 and 212. The guide piece 232 has a top rectangular frame having two length sides 236 and 238 connected by two width sides 240 and 242. Parallel walls 244 and 246 extend downwardly from the two length sides 236 and 238, respectively. An angled surface 250 extends from the outer edge 252 of the two width sides 240 and 242 to the wall section of the respective divider 210 and 212. An opening 260 is defined by the sides 236, 238, 240 and 242, and is aligned with the space 208*b*.

Referring to FIGS. 7-8, the connector 200 can be used in the truss system to connect a vertical web member 20 and one or two diagonal web members 40. FIGS. 7-8 show the lower end of the truss system. The base of the connector 200 is slid inside the channel of the horizontal chord 60, and secured with the top edges of the walls 202 and 204 fitted below the flanges 68 using pins 74. The entire guide piece 232 is positioned above the horizontal chord 60, with the bottom surfaces of the parallel walls 244 and 246 seated on top of the horizontal chord 60 and the dividers 210 and 212 extending through the opening 70 in the channel.

The bottom end of the vertical web member 20 can be inserted through the opening 260 into the space 208*b*, and the bottom end of a diagonal web member 40 can be inserted into either the space 208*a* or the space 208*c*, or two diagonal web members 40 can be inserted into the two spaces 208*a* and 208*c*. The angled surfaces 250 orient the diagonal web member(s) 40 in a diagonal orientation. Pins 74 can then be inserted through the openings 72, 222, and either 26 or 52 to secure the connector 200, the vertical web member 20, and the diagonal web member(s) 40 at the designated locations along the horizontal chord 60. The same connection using another connector 200 can be used at the upper end of the truss system.

The two dividers 210 and 212, and the guide piece 232, function as orientation devices for web membering and orienting the various vertical web member 20 and diagonal web members 40 into their desired orientations while providing sufficient stability for web membering heavy loads.

While the description above refers to particular embodiments of the present invention, it will be understood that many modifications may be made without departing from the spirit thereof. The accompanying claims are intended to cover such modifications as would fall within the true scope and spirit of the present invention.

What is claimed is:

1. A truss system, comprising:

a horizontal chord having a channel;

a connector retained inside the channel, comprising:

a base that has two parallel vertical walls, and a connecting base wall that together define a U-shaped cross-section, with a receiving space defined by the two parallel walls and the base wall;

first and second dividers positioned in the receiving space and defining separate first, second and third spaces, respectively, with the second space positioned between the first and third spaces, wherein each of the first and second dividers has a vertical wall section that is connected to the two parallel walls and the base wall, and an upper end;

a vertical web member having one end that is inserted into the second space; and a diagonal web member having one end inserted into either the first space or the third space.

2. The system of claim 1, wherein an angled surface is provided at the upper end of each vertical wall section each of the first and second dividers has a triangular section at the upper end thereof, each triangular section having a flat top surface, and the angled surface that extends from the flat top surface to the vertical wall section.

3. The system of claim 1, wherein each parallel wall has opposite first and second ends, and a beveled edge at each of the first and second ends.

4. The system of claim 1, wherein each parallel wall has a plurality of spaced-apart openings.

* * * * *